US005108263A

United States Patent [19]

Blotenberg

[11] Patent Number: 5,108,263

[45] Date of Patent: Apr. 28, 1992

[54] METHOD OF OPTIMIZING THE OPERATION OF TWO OR MORE COMPRESSORS IN PARALLEL OR IN SERIES

[75] Inventor: Wilfried Blotenberg, Dinslaken, Fed. Rep. of Germany

[73] Assignee: MAN Gutehoffnungshütte AG, Oberhausen, Fed. Rep. of Germany

[21] Appl. No.: 610,102

[22] Filed: Nov. 7, 1990

[30] Foreign Application Priority Data

Nov. 8, 1989 [DE] Fed. Rep. of Germany ..... 3937152

[51] Int. Cl.[5] ..... F04B 41/06; F04B 49/06

[52] U.S. Cl. ..... 417/2; 417/6; 417/53

[58] Field of Search ..... 417/2, 3, 4, 5, 6, 53

[56] References Cited

U.S. PATENT DOCUMENTS 4,330,237 5/1982 Battah ..... 417/53
4,486,148 12/1984 Battah ..... 417/53
4,807,150 2/1989 Hobbs ..... 417/4

*Primary Examiner*—Richard A. Bertsch
*Assistant Examiner*—David W. Scheuermann
*Attorney, Agent, or Firm*—Max Fogiel

[57] ABSTRACT

Method of optimizing the operation of two or more compressors in parallel or in series. Known methods of this type assume that the compressors are similar and attempt to optimize their operation by balancing the outputs of or the loads on the individual compressors. Although this approach is satisfactory within its limitations, it cannot be employed with compressors that are dissimilar. The new method is intended to ensure economically optimized operation of two or more similar or dissimilar compressors in parallel or in series. The new method is essentially characterized in that the operating points of each pair of compressors are mutually and incrementally displaced without affecting the total operation parameters. The affect of the displacement on the total constraint is monitored. When the variation is occurring in the direction of optimization, it is continued in the same direction. Otherwise, the pressure that the operating points are displaced in is reversed. The procedure gradually shifts the compressors over to the optimal combination of operating points. The new method can be employed to operate any type of compressor in parallel or in series in many technical fields—the chemical industry, the iron-and-steel industry, etc.

16 Claims, 2 Drawing Sheets

Figure 1:
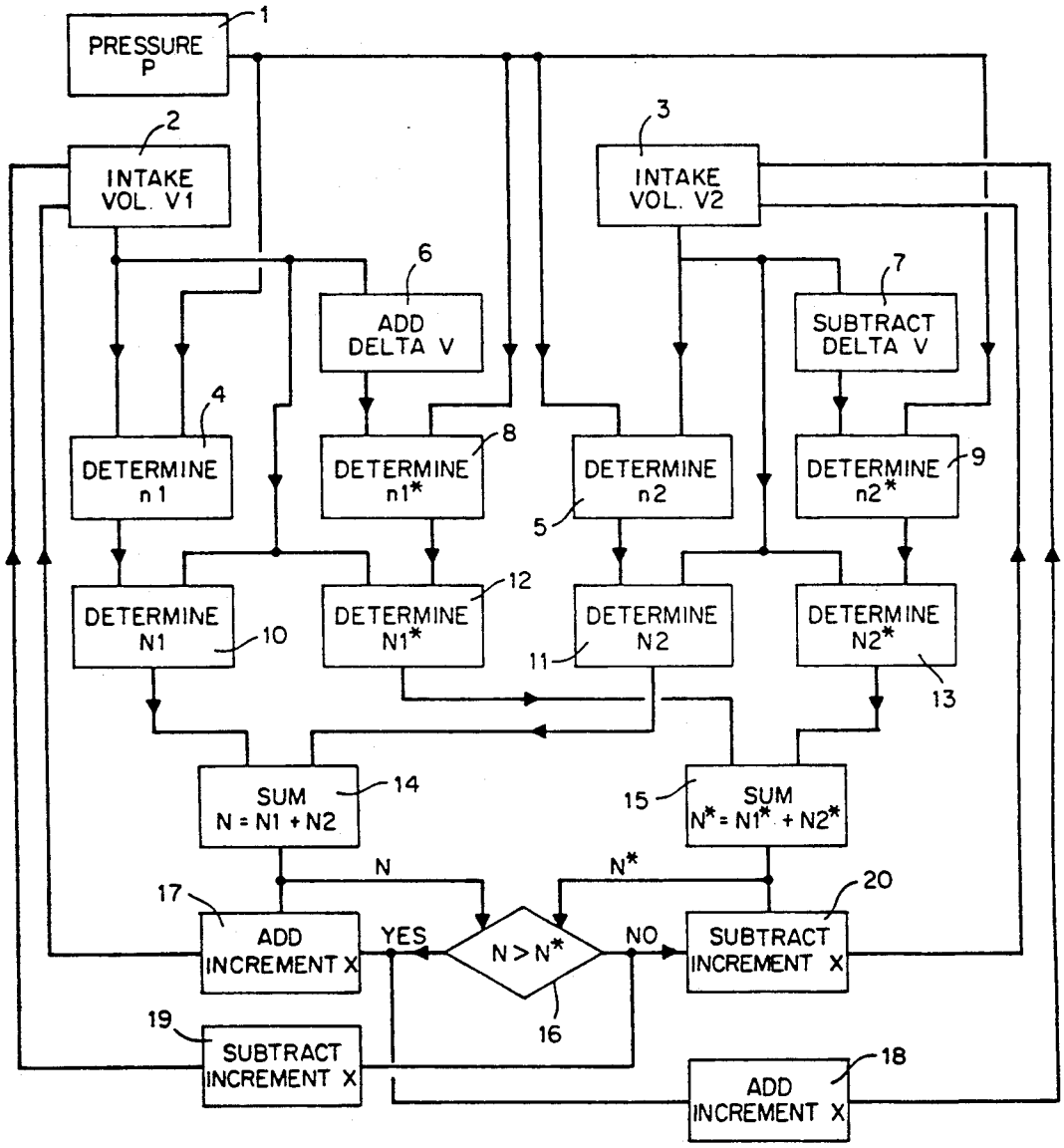

METHOD OF OPTIMIZING THE OPERATION OF TWO OR MORE COMPRESSORS IN PARALLEL OR IN SERIES

BACKGROUND OF THE INVENTION

A method of controlling compressors operated in parallel in a refrigeration system is known from U.S. Pat. No. 3,527,059. The power for the compressors is regulated in accordance with the empirically determined current of each coolant through its compressor to maintain both currents equal. The result is, assuming equivalent compressors, a uniform load and output for both. This method is not appropriate for dissimilar compressors, and even a uniform load on them will not necessarily result in economical operation.

A similar method is known from French 2 108 039. It is employed to control electrically powered parallel compressors in a refrigeration system. The objective of that method is also uniformity of the load on and output from the individual compressors. The amounts of electricity consumed by each compressor motor are determined and compared, and signals are derived therefrom to control the motors and ensure that each consumes the same amount of electricity. The aforesaid drawbacks occur in this case as well.

A method of operating two compressors in series is known from U.S. Pat. No. 4,255,089. This approach involves distributing the load between the two compressors by means of prescribed data stored in a memory in accordance with a control signal that represents the demands of a downstream system or process. The requisite data are in the form of series of sequences of linear functions. The drawback of this method is that it requires very large memories and, because of the relatively frequent recourse to the memory, is relatively slow and hence inappropriate for more than two compressors. It is also impossible for this method to respond to changes that occur in the compressors as they age, become contaminated, or undergo servicing for example once the memory data have been established. To address these problems would require the very complicated generation and entry of new memory data.

"Control of Parallel Compressors" by A. E. Nisenfeld et al., ISAAC Advances in Instrumentation, 31, 1 (1976), 581.1-585.7 discusses the problems involved in operating two compressors in parallel. Possible approaches to optimizing the operation that are mentioned in this article include the aforesaid uniform load distribution and maximizing the overall efficiency. Dynamic simulation of parallel compressor operation in a hybrid computer is suggested as one way of attaining the latter approach, although no more precise recommendations or concrete technical theories are provided.

Finally, a method of operating at least two turbocompressors is known from European Patent 0 132 487 B1. The core of this method is to match the compressors with load distributors such that the operating points of all the compressors will always be the same distance away from their blowoff line. Only one of the compressors is controlled by pressure regulators, and the others follow. The drawback to this method is that it can assure an approximately optimal operation only for similar compressors and not for different types.

SUMMARY OF THE INVENTION

The object of the present invention is accordingly to provide a method of the aforesaid type that will ensure economically optimized control of two or more similar or dissimilar compressors operating in series or in parallel with little expenditure of time or technology.

The embodiment of the method employed for operating two compressors in parallel will now be described with reference to FIG. 1, a block diagram of the computing program. It is assumed that both compressors are being operated at the same ultimate pressure p (1) that has either been empirically obtained or prescribed. It is also assumed that each compressor is being operated at an intake volumetric flow V1 or V2 (2 & 3) that has also either been empirically obtained or prescribed.

Two fields for each compressor are stored in a computer. One field represents speed of rotation over intake volumetric flow with ultimate pressure as the parameter and the other represents power over intake volumetric flow with speed of rotation as the parameter.

The speeds n1 (4) and n2 (5) for each operating point are obtained for each compressor from the speed field. The next step constitutes increasing intake volumetric flow V1 by an increment Δ V (6) and decreasing intake volumetric flow V2 by an equal decrement (7). The speeds n1* and n2* (8 & 9) associated with the accordingly modified operating point are now obtained from the two speed fields.

The next step constitutes obtaining the powers—N1 (10) & N2 (11) for the original operating point and N1* (12) & N2* (13) for the modified operating point—associated with the particular operational points from the compressors' power field. The letter N is employed to represent the power here instead of P to prevent confusion with the p that stands for pressure.

The overall power in relation to both operational points is now constructed by adding the sums $N=N1+N2$ (14) and $N^*=N1^*+N2^*$ (15). N is compared (16) with N* to decide which operational point consumes the least overall power.

If N* is lower than N (17), a new computering program commences with an intake flow V1 that is one increment X higher and with an intake flow V2 that is an equal decrement X lower (18). If N is lower than N*, flow V1 is decreased decrement X (19) and flow V2 increased by an equal increment X (20). The new program now begins with the point of departure displaced by increment X and detects whether further variation of the operating point by increment Δ V would result in an even lower overall power demand.

The program continues until an operating point is discovered at which the requisite overall flow V can be divided into the individual flows V1 and V2 for each compressor such that the power demand will be at a minimum.

Compressors can be continuously operated either parallel or in series in accordance with the invention at an operating point combination that is optimal with respect to the particular constraints employed, and whether the compressors being operated together are similar or dissimilar. Differences may be due to different models or series or just result from different operating lives or tolerances. Since the method in accordance with the invention completes each cycle very rapidly, the optimization is practically constant and simultaneous. The data, the parameters, needed for the method are usually obtained immediately and will not require any additional expenditure. It is also easy to vary the individual flow rates and pressure conditions incrementally by adjusting the variables appropriately, and whatever dimension is needed for establishing the variables can be derived from the specifications for each compressor. Every consumer will be familiar with these specifications, which are also available graphically. If the upper-echelon controls adjust the dependent variable, due to a change in the demands of the downstream process for example, the method in accordance with the invention will immediately shift the compressors over to the new optimal combination of operation points. Since the individual operational cycles are so rapid, systems with more than two compressors can also be optimized rapidly enough by repeatedly constructing every possible pair of compressors. The variable in this case is in particular a specific compressor speed, vane angle, or throttle constriction, and the particular dimension employed will depend on how the compressor's output is controlled as dictated by the technology and design. The variable is often a command on the part of a regulator to a downstream mechanism that controls speed, vane angle, or throttle constriction. If there are no transmission errors, the variable as just defined is often identical with the command. When transmission errors do occur, they are easy to detect, and corrections can be undertaken to eliminate their influence.

The compressors can be turbocompressors or helical compressors driven by a machine, an electric motor or turbine for example. The constraints can be those essential to the particular application, the compressors' power consumption or operating costs for example. The power consumption or operating costs of either the machines that drive the compressors or of such peripherals as coolant pumps, condensate pumps in the case of turbines, transformers in the case of electrically powered machinery, etc. can easily be exploited because the consumer will also be or can easily become familiar with their specifications.

What is of essence in an advanced embodiment is that some of the steps in the method are not carried out by the actual compressors but are simulated. This approach reduces the number of necessary adjustments to the compressors and limits them to those that have a desired effect, whereas unnecessary adjustments, those that have an undesired outcome, that is, never get to the compressors. Another result is a definite acceleration of each individual step in the method because the sequences of variations in the variables can be detected more rapidly by simulation than on the actual compressor. The prerequisite is that the field of constraints is in the memory, which presents no technical or arithmetical problems. It is sufficient in this case to store a number of curves of constant dimensions, and values between the curves can be adequately determined by interpolation.

One concrete embodiment of the method provides for operating two compressors in the form of a sequence of separate steps.

Several additional embodiments are also recited for parallel operation and will be described hereinafter.

To ensure not only the most rapid possible operation but also the establishment of the most precise possible optimal total constraint, the increments can be kept smaller as the optimum is approached. The result is more rapid operation when the optimum is farther away from the compressor-operating point and increasingly, admittedly slower, but more precise operation as the optimum approaches it.

Since different pressure losses will occur in practice at the compression end due not only to differences in the length and distribution of the pipelines that lead to the downstream process but also in accordance with the rate of flow when two or more compressors are operating in parallel, an embodiment provides for detecting the pressure situation for each compressor separately. This approach prevents the pipeline structure from affecting optimization of the operation.

Another situation that frequently accompanies the operation of compressors is that varying process demands require varying the system pressure and hence the ratio between the pressures generated by the compressors. A disclosed embodiment, is intended to achieve such variations as rapidly as possible. The new values associated with the variables are determined automatically while the method is in operation and the compressors switched to the operating points that are optimal for the new conditions.

In addition to variations in pressure, the process requisites can also vary with reference to flow rate. The method in this embodiment can also assume additional components of the objectives of conventional control and regulation procedures, generally keeping the expenditures involved in controlling and optimizing the compressor operation low. The conventional procedure can constitute either flow rate or pressure and can be activated in the latter case by comparing the total reference pressure to the instant pressure to generate the additional increments Y1 and Y2 with identical mathematical signs.

A concrete embodiment of the method for the series operation of two compressor in the form of a sequence of separate steps is also disclosed. These steps constitute a version of the method that is preferred for the specific case.

The point of departure for parallel operation is that all the compressors are running at the same ultimate pressure and that the total requisite flow can be distributed among all of them such the sum of the flows will be constant or correspond to the prescribed flow and that the total distributed power required will assume a minimum.

In series operation, all the compressors forward the same flow in terms of mass, and the pressure ratios (conditions) in the individual compressors must be distributed such that the overall pressure ratio will be constant and the total distributed power will be a minimum.

All that has to be done to the major claim accordingly is to replace pressure with mass flow and flow with pressure conditions, bearing in mind that the latter must be multiplied by a factor that will result in a constant overall pressure ratio.

Since this version is definitely too generalized, the description should contain the following passage reflecting the major claim.

Figure 2:
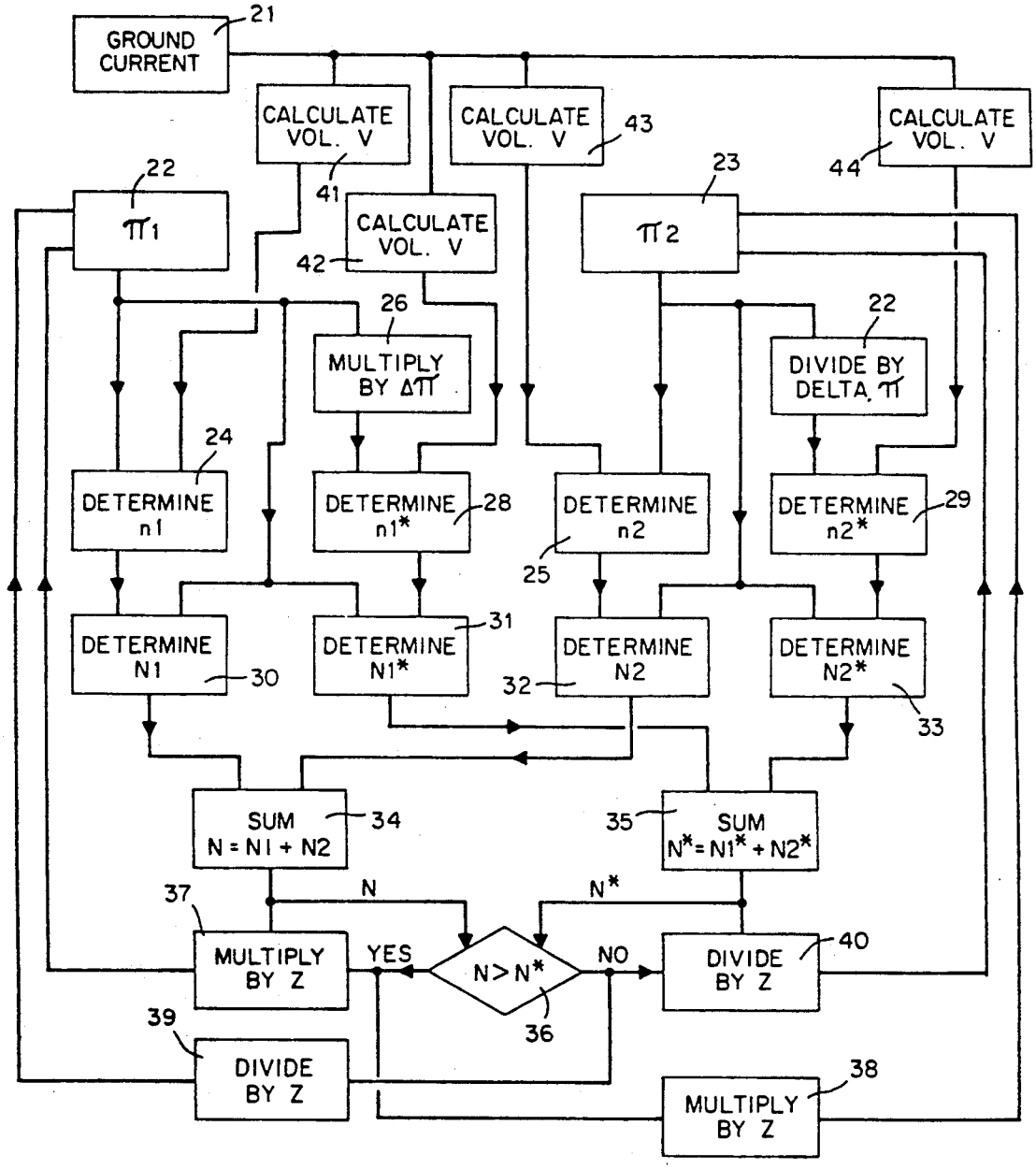

The embodiment of the method employed for operating two compressors in series will now be described with reference to FIG. 2, a block diagram of the computing program. It is assumed that both compressors are being operated at the same mass flow m (21) that has either been empirically obtained or prescribed. It is also assumed that each compressor is being operated at a pressure ratio $\pi = \pi 1 * \pi 2$.

Two field for each compressor are stored in a computer. One field represents speed of rotation over intake volumetric flow with the pressure ratio as the parameter and the other represents power over intake volumetric flow with speed of rotation as the parameter.

The calculations require preliminary conversion of the mass flow into intake volumetric flow (41 & 44) because a compressor field can only be unambiguously established by association the pressure ratio with the intake volumetric flow.

The speeds n1 (24) and n2 (5) for each operating point are obtained for each compressor from the speed field. The next step constitutes increasing pressure ratio $\pi 1$ one increment by multiplying it by a factor $\alpha\ \pi$ in the neighborhood of 1 and decreasing pressure ratio $\pi 2$ by dividing it by the same factor (27). Since it is necessary to prevent the total pressure ratio from being affected by these procedures, the increment must be obtained by multiplication, meaning that pressure ratio $\pi 1$ must be multiplied by a factor higher than 1 and pressure ratio $\pi 2$ divided by the same factor. The speeds n1* and n2* (28 & 29) associated with the accordingly modified operating point are now obtained from the two speed fields.

The next step constitutes obtaining the powers—N1 (30) & N2 (31) for the original operating point and N1* (32) & N2* (3s) for the modified operating point—associated with the particular operational points from the compressors' power fields.

The overall power in relation to both operational points is now constructed by adding the sums $N=N1+N2$ (34) and $N^*=N1^*+N2^*$ (s5). N is compared (16) with N* to decide which operational point consumes the least overall power.

If N* is lower than N (17), a new computing program commences with a pressure ration $\pi 1$ that is an increment Z (>1) higher (37) and with a pressure ratio $\pi 2$ that is an decrement 1/Z lower (38). If N is lower than N*, pressure ratio $\pi 1$ will be divided by Z and hence decreased (39) and pressure ratio $\pi 2$ multiplied by Z and hence increased to the same extent (40). The new program now begins with the point of departure displaced by this increment and detects whether further variation of the operating point by increment $\Delta$ V would result in an even lower overall power demand.

The program continues until an operating point is discovered at which the requisit overall flow V can be divided into the individual flows V1 and V2 for each compressor such that the power demand will be at a minimum.

In accordance with the present invention furthermore the incremental factors are decreased as proximity to the optimum increases, resulting in a method that is not only rapid but also precise in vicinity of the optimum.

Similar to the embodiment for operation in parallel, another embodiment defines relation to series operation how the method handles changes in the requisites with reference to the total-pressure situation and deriving from the process. The method can in this case as well assume some of the functions of the conventional control procedure. If the flow rate of compressors operating in series is to be increased, the requisite increased flow must first be converted into mass flow if it is not already being detected in that unit. The mass flow must then be converted back to the specific volumetric flow associated with each compressor in the series in terms of the rated density and instant pressure and temperature at its intake. The volumetric flow can then be exploited to derive variables and constraints from the appropriate fields. The conventional control system can of course consist of regulating not only the pressure conditions but also the flow, with the latter approach obtained by comparing the total reference flow rate to the instant flow rate in order to generate the additional increments Y'.

Advanced versions of the method that are appropriate for both parallel and series operation will now be specified.

How rapidly a variable can be varied in practice is often limited for reasons of engineering on how rapidly a compressor or its controls can be operated. It is accordingly practical to also limit the rapidity of variable variation attainable by the method in accordance with the invention. This is done by restricting the increments to appropriate levels, which depend on the desired maximal rate of adjustment and on how long each cycle in the method takes.

The operating costs of the power—electricity for example—that drives the compressors and any accessories that many be necessary are not always the same but are often lower at different times of day and different seasons, and the method addresses these oscillations by maintaining a supply of appropriate constraint fields.

To allow the method to be carried out as rapidly as possible when applied to more than two compressors as well, a further embodiment restricts the adjustment of variables to pairs of compressors that will result in the relatively greatest effect in the desired direction. Variable adjustments that contribute only slightly or in essentially to optimization while requiring relatively long times are accordingly suppressed.

When there are several compressors in one plant, situations often occur wherein the pressures and flow rates dictated by the process can be satisfied with different figures and/or combinations of compressors. Due to the non-linearity of the compressors' characteristics, it will not for example always be immediately evident whether it is more effective to operate a smaller number of compressors at a full load or overloaded or a larger number of compressors at partial load. When different types of compressor are employed in one system, the additional question arises of what combination is optimal when all of them do not have to be in operation. This problem can be solved with the disclosed embodiment, which allows unambiguous determination of the optimal number and combination of compressors for attaining the particular process demands in question.

Another situation that occurs in conjunction with the operation of compressors is the blowoff of one or more of them subject to surge limitation, in conjunction with a sudden decrease in the volumetric flow being accepted by the process for example. In one disclosed embodiment blowoff is prevented from affecting the method and its optimization by ensuring that only the relevant volumetric flow, the flow that participates in the process, that is, will be included in the method.

The embodiments of the method described hereintofore are based on the assumption of only one optimum in the operating range of the compressor or combination of compressors. There may on the other hand be several optima, which can result in the creation of a relative optimum that does not represent the absolute optimum. One way of avoiding this undesired result is presented in a disclosed embodiment. This embodiment constantly searches the total operating range for relative optima and selects the absolute optimum from among them.

The point of departure for almost all of the applications of the method that occur in practice is the assumption that the medium being compressed is of an essentially constant composition and intake temperature. To allow use of the method in cases wherein the composition and intake temperature and hence the gas parameters of the medium fluctuate widely, it is advisable to utilize the forwarding level or difference in enthalpy instead of a field with a pressure ratio ranging over the intake volumetric flow. The pressure ratio can be converted into a forwarding level or enthalpy difference by way of the known physical contexts and conversion formulas. The pressure conditions continue to be detected and the incremental factors varied as the method proceeds, although the aforesaid conversion is carried out before the variables are determined.

The new method can be employed for the parallel or series operation of any compressors in many engineering applications—for chemical engineering, especially in petrochemistry, for the transportation of gas in pipelines, in the iron-and-steel industry, especially for operating blast furnaces, and in other, especially industrial, fields.

I claim:

1. A method of optimizing operation of at least two compressors connected in parallel or series to compress and forward gaseous or vaporous materials, comprising the steps of: detecting actual operating parameters that dictate an instant operating point of variables for each compressor; controlling said compressors in accordance with demands of a downstream process and in response to surge control; displacing periodically operating points of each pair of compressors by mutual additive incremental variation of individual volumetric flow without affecting instant total volumetric flow or pressure conditions when the compressors are operated in parallel; displacing periodically operating points of the compressors by mutual multiplicative incremental variation of individual pressure conditions without affecting instant total flow rate or pressure conditions when the compressors are operated in series; adjusting said variables when said compressors are operated in parallel or series; varying additionally in increments individual volumetric flows or pressure conditions depending on the resulting direction of variation in total constraints in said adjusting step as said variables approach optimum values for reduction in total power consumption or operating costs if the variations are in the same direction; varying in increments individual volumetric flows or pressure conditions in an opposite direction if the variations reverse direction and recede from optimum values by increasing total power consumption or operating costs, said steps of varying when said variables approach optimum values and recede from optimum values being carried out by constant readjustment of the variables; and selecting alternating pairs of compressors by constructing every possible permutation of compressors in sequence when more than two compressors are operated, so that said optimum values are continuously sought and found for optimum operation of the compressors even when the operating points vary continuously by responding to any variation in one of said actual operating parameters.

2. A method as defined i claim 1, wherein increments Y1 and Y2 or Y' are restricted to maxima $Y1_{max}$ and $Y2_{max}$ or $Y'_{max}$ representing the desired maximal rate that the variables are adjusted at.

3. A method as defined in claim 1, wherein in the event of blowoff in at least one compressor, the empirically determined intake volumetric flow is diminished by a component blown off or the volumetric flow arriving at the process is determined directly.

4. A method as defined in claim 1, wherein (a) once an optimal total compressor constraint has been attained, the operating point associated with it is retained, (b) initiating subsequently several times an incremental and mutual, actual or computer-simulated, displacement of the operating point within the boundary of the field without affecting the total operating parameters by multiply increasing the increment in the individual volumetric flows or individual pressure conditions by a factor that is substantially greater than 1, (c) re-establishing an optimal total constraint with each new pair of operating points as a point of departure, and comparing each new optimum with the originally detected optimum for establishing an absolute optimum, and (d) shifting subsequently the compressors over to the operating points corresponding to the optionally reestablished absolutely optimal total constraint when necessary by varying the individual variables.

5. A method as defined in claim 1, including the step of computer simulating initially displacement of the operating points of the compressors, obtaining the total constraint from fields stored in association with each compressor and establishing the resulting variation in the direction of the total constraint, said compressor variables being actually adjusted only once a variation has been detected in the direction of optimization for reduced total power consumption or operating costs, or not until an optimal total constraint has been detected, plotting each constraint in the constraint field as a function of the intake volumetric flow or pressure conditions, and entering characteristics for all continuous variables.

6. A method as defined in claim 5, wherein a plurality of constraint fields are provided for each compressor with data sets that vary in accordance with time of day, day of the week, and time of the year.

7. A method as defined in claim 5, wherein more than two compressors are in operation and once every permutation of the pairs of compressors has been exhausted, adjusting only the variable for the compressors in the pair that exhibits the greatest variation in total constraints in the direction of optimization.

8. A method as defined in claim 5, wherein processing requirements with respect to volumetric flow and pressure conditions for each individual compressor and each possible permutation of at least two compressors, the optimal constraint or optimal total constraint is determined for each requirement, comparing the optimal total constraints, a compressor or permutation of compressors exhibiting the absolutely optimal constraint or optimal total constraint being in operation and being shifted to the operating point or points.

9. A method as defined in claim 5, wherein for each pair of compressors in series:

(a) obtaining the variables n1 or n2 associated with the instant operating point from each individually stored field plotting always ultimate compressor pressure or the pressure conditions in the variable field by way of the intake volumetric flow, and entering characteristics for all continuous variables, (b) increasing the arithmetical value obtained for pressure conditions 01 by multiplying by an incremental factor 0 that is greater than 1 and decreasing the arithmetical value obtained for pressure conditions 02 by dividing by the same factor and, assuming constant flow through both compressors, determining the intake volumetric flow varied as a function of the variation in the pressure conditions in accordance with the resulting variation in density to displace the operating point in the computer simulation, (c) obtaining the variable n1* and n2* associated with the displaced operating point from the variable fields stored in relation to each compressor, (d) obtaining from the stored constraint fields, the constraints N1 and N and N1* and N2* associated with the instant and with the displaced operating points for both compressor and representing their individual power consumption and operating costs, (e) constructing and comparing the total constraints $N=N1+N2$ and $N^*=N1+N2^*$ representing the total power consumption or operating costs, and (f1) if N* is lower than N, increasing actually the pressure conditions 01 in the first compressor by adjusting its variable by multiplying by an incremental factor Z that is greater than 1 and decreasing actually the pressure conditions 02 in the second compressor by the same incremental factor Z by adjusting its variable by division and repeating step (a) or, if N is lower than N*, pressure conditions 01 decreasing in computer-simulation by dividing by an incremental factor Z that is greater than 1 and increasing pressure conditions 02 in computer-simulation by multiplying by the same incremental factor Z and repeating step (b) or (f2) if N* is lower than N, increasing pressure conditions 01 in computer-simulation by multiplying by an incremental factor Z that is greater than 1 and decreasing pressure conditions 02 in computer-simulation by dividing by the same incremental factor Z and repeating step (b) or if N is lower than N*, decreasing pressure conditions 01 in computer-simulation by dividing by an incremental factor Z that is greater than 1 and increasing pressure conditions 02 in computer-simulation by multiplying by the same incremental factor Z and repeating step (b) or, if repeated comparison of the total constraints reveals one that is optimal, displacing the compressor variables, shifting the compressors over to the optimal total, and repeating step (a).

10. A method as defined in claim 9, wherein incremental factors O and Z are varied in accordance with the detected differences N−N* between the total constraints from one run to another and are decreased as the differences decrease, corresponding to approaching the optimal total, and vice versa.

11. A method as defined in claim 9, wherein instant total pressure conditions are continuously directly entered in form of a total pressure-conditions reference or obtained in form of an operating-parameter reference from an upstream compressor regulator and when it becomes desirable to vary the total pressure-conditions reference due to a difference between the total pressure-conditions reference and the product of the individual pressure conditions 01 and 02, not only are the flow mutually varied by incremental multiplication, but they are also multiplied by a factor Y' of the same dimension and mathematical sign that corresponds to the desired factor that the total pressure conditions are to be increased by.

12. A method as defined in claim 5, wherein for each pair of parallel compressors, (a) variables n1 or n2 associated with the instant operating point are obtained from each individually stored field; plotting always the pressure conditions in the variable field as a function of the intake volumetric flow, and entering characteristics for all continuous variables, (b) increasing the arithmetical value for one intake volumetric flow V1 by adding an increment V and decreasing the arithmetical value obtained for the other intake volumetric flow V1 by subtracting the same increment V to displace the operating point int he computer simulation, (c) obtaining the variable n1* or n2* associated with the displaced operating point from the variable field stored in relation to each compressor, (d) obtaining from the stored constraint fields the constraints N1 and N2 and N1* and N2* associated with the instant and with the displaced operating points for both compressors and representing their individual power consumption and operating costs whereby N1 is the instant constraint on the first and N2 the instant constraint on the second compressor and N1* is the constraint on the first compressor associated with the displaced operating point and N2* is the constraint on the second compressor associated with the displaced operating point, (e) constructing and comparing the total constraints $N=N1+N2$ and $N^*=N1^*+N2^*$ representing the total power consumption or operating costs and (f1) if N* is lower than N, increasing actually the intake volumetric flow V1 into the compressor by an increment X by adjusting its variable and decreasing actually the intake volumetric flow V2 into the second compressor by the same increment X by adjusting its variable and repeating step (a) or, if N is lower than N*, decreasing intake volumetric flow V1 in computer-simulation by an increment X and increasing intake volumetric flow V2 in computer-simulation by the same increment X and repeating step (b) or (f2) if N* is lower than N, increasing intake volumetric flow V1 in computer-simulation by an increment X and decreasing volumetric flow V2 in computer-simulation by the same increment X and repeating step (b) or if N is lower than N*, decreasing intake volumetric flow V1 in computer-simulation by an increment X and increasing volumetric flow V2 is computer-simulation by the same increment X and repeating step (b) or, if repeated comparison of the total constraints reveals one that is optimal, displacing the compressor variables, shifting the compressors over to the optimal total, and repeating step (a).

13. A method as defined in claim 12, wherein increments V and X are varied in accordance with the detected differences N−N* between the total constraints from one run to another and are decreased as the differences decrease corresponding to approaching the optimal total and vice versa.

14. A method as defined in claim 12, wherein the pressure conditions are determined individually for each compressor in accordance with length of the line between its outlet and a downstream process, with its particular volumetric flow, and with the particular pressure loss characteristic of the line.

15. A method as defined in claim 12, wherein instant pressure conditions are continuously detected by at least one sensor or obtained in form of a reference from a compressor regulator.

16. A method as defined in claim 12, wherein the instant total volumetric flow is continuously directly entered in form of a total volumetric-flow reference or obtained in form of an operating-parameter reference from an upstream compressor regulator and when it becomes desirable to vary the total volumetric flow due to a difference between the total volumetric-flow reference and the sum of the individual volumetric flows V1 and V2, not only are the flow mutually incrementally varied, but they are also varied by an increment Y1 and Y2 with the same mathematical sign, whereby the sum of the increments Y1 and Y2 equals the difference between the total volumetric-flow reference and the sum of the individual volumetric flows V1 and V2.

* * * * *